US007325368B2

(12) United States Patent
Miyaoka et al.

(10) Patent No.: US 7,325,368 B2
(45) Date of Patent: Feb. 5, 2008

(54) APPARATUS FOR FEEDING INNER WRAPPER FOR WRAPPING CIGARETTE BUNDLES

(75) Inventors: Norikuni Miyaoka, Tokyo (JP); Shinichi Hyodo, Tokyo (JP)

(73) Assignee: Japan Tobacco Inc., Tokyo (JP)

( * ) Notice: Subject to any disclaimer, the term of this patent is extended or adjusted under 35 U.S.C. 154(b) by 0 days.

(21) Appl. No.: 11/328,241

(22) Filed: Jan. 10, 2006

(65) Prior Publication Data

US 2006/0168909 A1 Aug. 3, 2006

Related U.S. Application Data

(63) Continuation of application No. PCT/JP2004/010133, filed on Jul. 15, 2004.

(30) Foreign Application Priority Data

Jul. 16, 2003 (JP) ..... 2003-275478

(51) Int. Cl.
*B65B 57/02* (2006.01)

(52) U.S. Cl. ..... 53/64; 53/167; 53/389.3

(58) Field of Classification Search ..... 53/64, 53/167, 426, 234, 389.3; 493/373
See application file for complete search history.

(56) References Cited

U.S. PATENT DOCUMENTS 3,416,289 A * 12/1968 Sebelin ..... 53/55
3,432,982 A * 3/1969 Aulmann et al. ..... 53/479
3,815,313 A * 6/1974 Heisler ..... 53/413
3,848,393 A * 11/1974 Monoghan ..... 53/427
3,884,012 A * 5/1975 Ernstsson et al. ..... 53/426
3,906,893 A 9/1975 Scales
4,573,305 A * 3/1986 Wildmoser ..... 53/466
5,197,938 A * 3/1993 Chmielewski ..... 493/373
5,822,951 A * 10/1998 Rosik ..... 53/432
6,357,201 B1 * 3/2002 Focke et al. ..... 53/167
6,449,925 B1 * 9/2002 Otsu et al. ..... 53/428
6,769,226 B2 * 8/2004 Holland et al. ..... 53/411

FOREIGN PATENT DOCUMENTS

JP 58-023781 A 2/1983
JP 4-279415 A 10/1992
JP 2000-006929 A 1/2000
JP 2000-118510 A 4/2000
JP 2002-193356 A 7/2002
WO WO-02/26563 A1 4/2002

* cited by examiner

*Primary Examiner*—Sameh H. Tawfik
(74) *Attorney, Agent, or Firm*—Birch, Stewart, Kolasch & Birch LLP.

(57) ABSTRACT

An apparatus for feeding an inner wrapper for an inner pack in a cigarette package has a rotatable web roll (R) formed by winding a web for the inner wrapper. The web has aluminum foil and a paper layer laminated onto the aluminum foil and containing menthol. The feeding apparatus further includes a scraper roller (45) for removing the menthol from the outer circumferential surface of the web roll (R), namely the surface of the aluminum foil. The scraper roller (45) has a plurality of scrapers (55) arranged in the outer circumferential surface thereof, the scrapers (55) being brought into contact with the outer circumferential surface of the web roll (R). The scrapers (55) are made of felt material.

6 Claims, 4 Drawing Sheets

APPARATUS FOR FEEDING INNER WRAPPER FOR WRAPPING CIGARETTE BUNDLES

TECHNICAL FIELD

The present invention relates to an apparatus for feeding an inner wrapper for wrapping cigarette bundles in cigarette packages, and more specifically to an apparatus for feeding an inner wrapper, which is capable of adding an aroma other than original tobacco flavor and taste to each of the filter cigarettes contained in cigarette bundles.

BACKGROUND ART

This type of aromatic substance for filter cigarettes is directly added to shred tobacco or filter fibers of filter cigarettes. Alternatively, it is applied to an inner wrapper for wrapping cigarette bundles. For example, U.S. Pat. No. 3,906,893 discloses an apparatus for fabricating an inner wrapper, namely web, to which menthol is applied.

More specifically, the web is obtained by laminating aluminum foil to be faced to the outside and a paper layer to the inner side. According to the apparatus disclosed in the U.S. patent, liquid menthol as an aromatic substance is applied to the back of the web delivered from a feed spool, and is infiltrated into the paper layer. The apparatus subsequently winds the web infiltrated with the aromatic substance around a take-up spool to form a web roll for inner wrapper.

In the case that the above-mentioned web roll is used in a machine for wrapping cigarette packages, namely an apparatus for feeding the inner wrapper, the web is guided along a feeding path from the web roll to a cutting position, where the web is cut into an inner wrapper with the given length. Thereafter, the packing machine wraps the cigarette bundle in the inner wrapper to form an inner pack, and then further wraps the inner pack in outer wrapper to form a cigarette package.

If the aromatic substance is infiltrated into the paper layer of the inner wrapper as described, fragrance components vaporized from the aromatic substance are absorbed into the filter cigarettes in the inner pack, thereby giving the additional aroma to the filter cigarettes.

When the web infiltrated with the aromatic substance is in the form of the web roll, the aromatic substance is transferred from the paper layer to the outside face of the web, namely aluminum foil, adjoining the paper layer. Therefore, when the web is drawn from the web roll to the cutting position, the aromatic substance adheres to guides, such as lots of guide rollers and guide plates for forming the feeding path, which smears the guides. Especially the aluminum foil is smoother than the paper layer, so that it is more liable to smear the guides with the aromatic substance, compared to the paper layer.

When the guides are smeared with the aromatic substance, the web is likely to slip or meander. In this event, the forming and feeding of the inner wrapper in the feeding apparatus are not properly carried out, which causes defectiveness in fabrication of the inner packs in the packing machine. In the worst case, the web transfer itself becomes impossible, and the packing machine even comes to a halt.

DISCLOSURE OF THE INVENTION

It is an object of the present invention to provide an apparatus for feeding an inner wrapper, which is capable of reducing adhesion of an aromatic substance to guides for forming a feeding path when a web added with the aromatic substance is drawn from a web roll along the feeding path, and of satisfactorily fabricating inner packs by using a packing machine.

To accomplish the above object, the apparatus for feeding an inner wrapping according to the present invention has a web roll rotatably supported and wound with a web that is material for the inner wrapper, the web including metal foil and a paper layer that is laminated on the metal foil and contains an aromatic substance; a feeding path for guiding the web delivered from the web roll to a feeding position; a cutting unit arranged in the feeding path, for cutting the web to form the inner wrapper; and a cleaner arranged in the feeding path including the web roll, for cleaning an outside surface of the metal foil in the web.

Specifically, the aromatic substance is menthol, and the cleaner includes a scraper brought into sliding contact with the outside surface of the metal foil in an outer circumferential surface of the web roll.

According to the feeding apparatus, even if the aromatic substance is transferred from the paper layer of the web to the outside surface of the metal foil in the state that the web is in the form of a web roll, the scraper removes or cleans the aromatic substance transferred to the surface of the metal foil when the web is delivered from the web roll.

For that reason, the aromatic substance that adheres to the guides for forming the feeding path of the web is small in amount. This prevents a slip, meander, and jam of the web, attributable to adhesion of the aromatic substance. Consequently, an inner wrapper obtained by cutting the web is accurate in both size and the feeding position, resulting in excellent wrapping of cigarette bundles with the inner wrapper, that is, excellent fabrication of an inner pack.

More specifically, the cleaner further includes an arm having a base end rotatably supported near the web roll and urged toward the outer circumferential surface of the web roll, and a holder mounted on a distal end of the arm, the holder having the scraper.

In this case, when the web roll is reduced in diameter, the scraper is constantly urged toward the web roll. This enables the scraper to remove the aromatic substance adequately from the web, or the outside surface of the metal foil.

It is preferable that the holder be rotatable with respect to the arm and have a plurality of scrapers. In this case, the holder forms a scraper roller. The scraper roller includes a roller shaft supported by the arm, a sleeve rotatably supported by the roller shaft, a one-way clutch disposed between the sleeve and the roller shaft, for allowing the sleeve to only rotate in the same direction as a rotating direction of the web roll, and a roller shell detachably fixed onto the sleeve, the scrapers being arranged in an outer circumferential surface of the roller shell at intervals in a circumferential direction of the roller shell.

When the web roll rotates while the web is delivered, the scraper roller is not rotated by means of the one-way clutch. Accordingly, at least one of the scrapers of the scraper roller can remove or clean the aromatic substance from the web without fail.

The aromatic substance removed from the web is trapped in a concavity defined between the scrapers in the scraper roller, which prevents the aromatic substance from spattering. Moreover, since the scraper roller has the plurality of scrapers, it is possible to press a new scraper onto the outer circumferential surface of the web roll by the rotation of the scraper roller. In short, the scrapers can be easily replaced.

Preferably, the scrapers are made of felt material. In this case, the scrapers can remove the aromatic substance satisfactorily without damaging the outside face of the web, namely the metal foil.

The feeding apparatus may further include a detector for detecting whether or not a diameter of the web roll reaches a minimum diameter for determining a use limit of the web roll. In this case, the detector has a bobbin for supporting the web roll and having a flange, and a contact member fixed to the scraper roller and adapted to bring into contact with the flange of the bobbin when the diameter of the web roll reaches the minimum diameter.

In the above case, since the contact member of the detector is fixed to the scraper roller, it is not necessary to prepare an arm for supporting the contact member. The detector is indispensable when the feeding apparatus continuously feeds the web.

BEST MODE OF CARRYING OUT THE INVENTION

Figure 1:
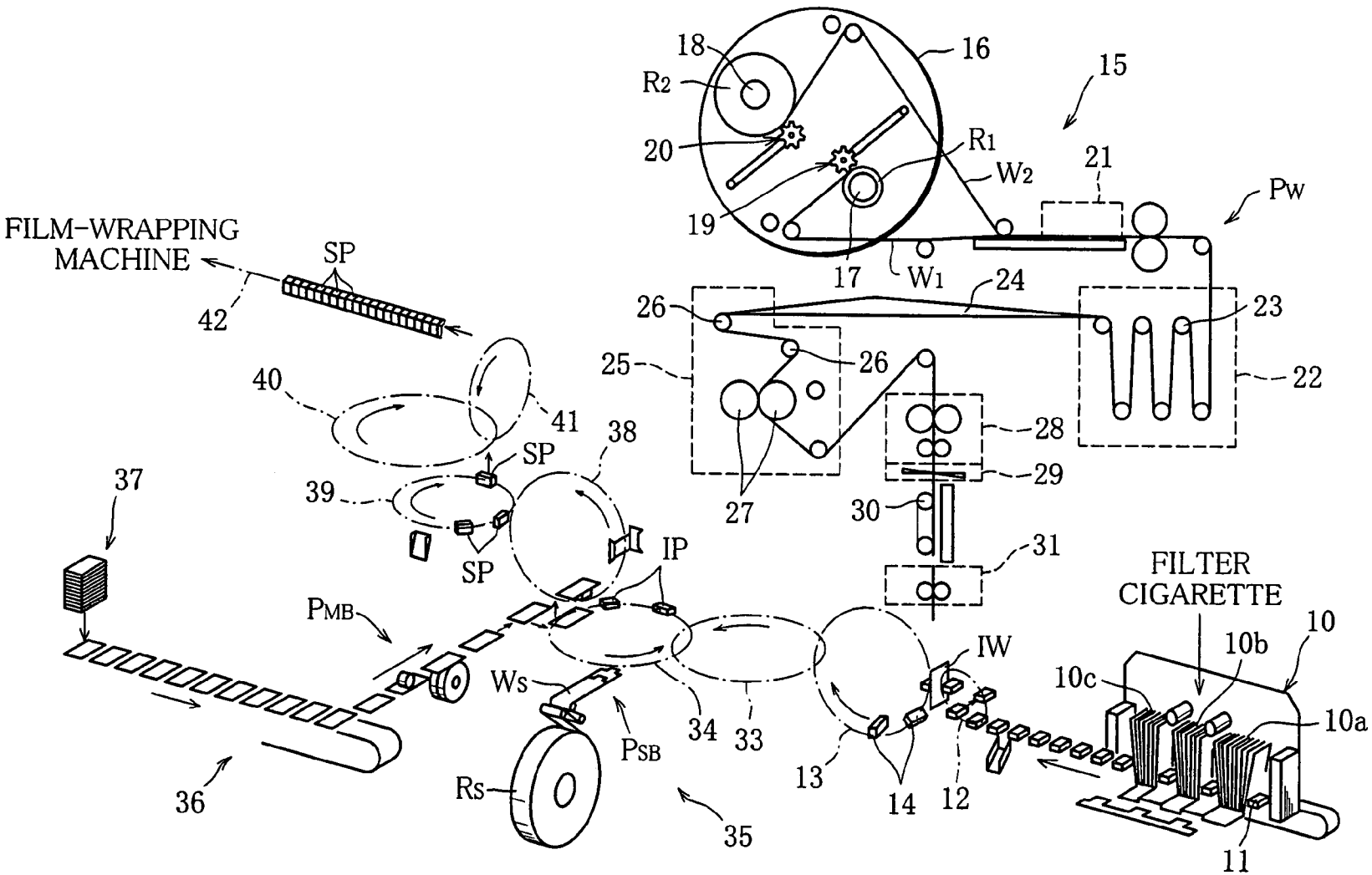
FIG. 1 is a schematic view of a packing machine provided with scratching devices according to one embodiment.

A packing machine of FIG. 1 is provided with a hopper device 10. The hopper device 10 has three hoppers 10*a*, 10*b* and 10*c*, and a large number of filter cigarettes are stored in the hoppers. The hoppers 10*a*, 10*b* and 10*c* are arranged adjacently to each other in a transferring direction of accumulation pockets 11. Each of the accumulation pockets 11, when passing through one hopper, receives a given number of filter cigarettes from the hopper. Consequently, when the accumulation pocket 11 passes through all the three hoppers, a cigarette bundle in a block-like shape is accommodated in the accumulation pocket 11. The cigarette bundle includes twenty filter cigarettes. In the accumulation pocket 11, the filter cigarettes are arranged in the form of upper, middle, and lower tiers. More specifically, the upper and lower tiers each include seven filter cigarettes, and the middle tier has six.

Thereafter, the accumulation pocket 11 is transferred along a transfer line to a first wheel 12 shown by a single dashed line. The first wheel 12, while rotating, receives a cigarette bundle from the accumulation pocket 11 and transfers the received cigarette bundle toward a second wheel 13 shown by a single dashed line. The first and second wheels 12 and 13 are disposed in a vertical position.

The second wheel 13 has a plurality of folding pockets 14. The folding pockets 14 are arranged at regular intervals in a circumferential direction of the second wheel 13. As the second wheel 13 rotates, each of the folding pockets 14 receives a cigarette bundle from the first wheel 12 and receives a sheet-like inner wrapper IW at the same time. The inner wrapper IW is then wound around the cigarette bundle into the shape of the letter U within the corresponding folding pocket 14.

The inner wrapper IW is fed from an inner wrapper feeder 15 to between the first and second wheels 12 and 13. The inner wrapper feeder 15 is provided with a vertical rotary turret 16. The rotary turret 16 has two bobbins 17 and 18. The bobbins 17 and 18 are disposed away from each other in a diametral direction of the rotary turret 16. Web rolls $R_1$ and $R_2$ are attached to the bobbins 17 and 18, respectively.

Each of the web rolls R includes a circular core and a web W wound around the core. The web W has aluminum foil forming the outside face of the web W, a paper layer laminated onto the aluminum foil and forming the inner side face of the web W, and an aromatic substance, for example menthol, applied to and infiltrated into the paper layer.

The rotary turret 16 is provided with scratching devices 19 and 20 near the web rolls $R_1$ and $R_2$, respectively. The scratching devices 19 and 20 will be described below in detail.

When the inner wrapper feeder 15 is in a state shown in FIG. 1, the web $W_1$ delivered from the web roll $R_1$ is guided along a feeding path $P_W$. The feeding path $P_W$ extends toward the first and second wheels 12 and 13, and has a terminal end in a region between the wheels 12 and 13.

In the feeding path $P_W$ an automatic splicing unit 21 is arranged. The web $W_1$ delivered from the web roll $R_1$ passes through the automatic splicing unit 21, a sub feed unit 80, a web reservoir 22, a traveling guide 24, an embossing unit 25 and a main feed unit 28 in order. The sub and main feed units 80 and 28 cause the web $W_1$ to run in cooperation with each other.

The web $W_2$ of the web roll $R_2$ is drawn out to reach the automatic splicing unit 21. In this case, the web roll $R_1$ is used as an active roll, while the web roll $R_2$ is a standby roll.

In cooperation with the sub feed unit 80 and the web reservoir 22, the automatic splicing unit 21 switches the active roll from the roll $R_1$ to the roll $R_2$. More specifically, when a remaining amount of the web $W_1$ of the web roll $R_1$ becomes equal to or less than a given amount, the sub feed unit 80 is activated at faster speed than the main feed unit 28. For this reason, the web reservoir 22 stores the web $W_1$ of a given length therein by using a plurality of dancer rollers 23. Thereafter, the delivery of the web $W_1$ from the web roll $R_1$, which is carried out by the sub feed unit 80, is stopped. In this state, the automatic splicing unit 21 connects a distal end of the web $W_2$ to the web $W_1$, and then cuts the web $W_1$ upstream from a position where the webs are spliced to each other. Subsequently, the automatic splicing unit 21 activates the sub feed unit 80 again, thereby switching the delivery of the web W from the roll $R_1$ to the roll $R_2$.

During the splicing work of the webs, the web $W_1$ stored in the web reservoir 22 continues to be fed toward the embossing unit 25. This enables continuous feeding of the web W, and tension of the web W is retained at a fixed degree because of the dancer rollers 23 of the web reservoir 22.

The embossing unit 25 includes an internal path for the web W, which is formed by a plurality of guide rollers 26, and a pair of emboss rollers 27 inserted in the internal path. When the web W passes between the emboss rollers 27, the emboss rollers 27 form embosses with a given pattern in the web W.

The web W that has been embossed is fed from the embossing unit 25 through the main feed unit 28 to a cutting unit 29. The cutting unit 29 then cuts the web W into pieces with a given length, thereby forming the inner wrappers IW from the web W. Subsequently, the inner wrappers IW are sequentially fed through suction feed belts 30 and an acceleration roller unit 31 to the terminal end of the feeding path $P_W$, and are pushed into the folding pockets 14 of the second wheel 13 together with cigarette bundles as described above.

The second wheel 13 is rotated, the cigarette bundle in the corresponding folding packet 14 is transferred in the circumferential direction of the second wheel 13. In this transferring process, the folding of an end flap for closing the end face of the cigarette bundle and the folding of side flaps for closing both side faces of the cigarette bundle are carried out in order as is publicly known with respect to the inner wrapper IW wound around the cigarette bundle, to thereby form an inner pack IP.

As illustrated in FIG. 1, a third wheel 33 adjoins the second wheel 13. The third wheel 33 is disposed away from the first wheel 12 in a diametral direction of the second wheel 13. The third wheel 33 has a plurality of transfer pockets (not shown). The transfer pockets sequentially receive their respective inner packs IP from the second wheel 13 while the third wheel rotates. Subsequently, the inner packs IP are transferred in a circumferential direction of the third wheel 33 together with the transfer pockets.

A fourth wheel 34 adjoins the third wheel 33. The fourth wheel 34 is disposed in a horizontal position in the same manner as the third wheel 33. More specifically, the fourth wheel 34 is located under the third wheel 33. Outer circumferences of the third and fourth wheels 33 and 34 partially overlap with each other in a vertical direction. The inner pack IP on the third wheel 33, when reaching the fourth wheel 34, is transferred from the third wheel 33 into a transfer pocket of the fourth wheel 34. The inner pack IP is then transferred in a circumferential direction of the fourth wheel 34 while the fourth wheel 34 rotates.

The fourth wheel 34 is connected to a sub blank feeder 35. The sub blank feeder 35 feeds a sub blank to a transfer pocket of the fourth wheel 34 before the transfer pocket receives the inner pack IP.

More specifically, the sub blank feeder 35 is provided with a web roll $R_S$. The blank roll $R_S$ delivers a web $W_S$ along a feeding path $P_{SB}$. In the feeding path $P_{SB}$, a notch/cutter roller, a feed unit and a cutting unit are arranged in order from the roll $R_S$ side although none of them is shown in FIG. 1. The feed unit intermittently feeds the web $W_S$. In this feeding process, the notch/cutter roller forms a pair of side fold lines and the like in the web $W_S$, and the cutting unit cuts the web $W_S$ into pieces with a given length, to thereby form a sub blank.

When a transfer pocket of the fourth wheel 34 reaches the third wheel 33 after receiving a sub blank, an inner pack IP of the third wheel 33 is pushed into the transfer pocket together with the sub blank. At this moment, the sub blank is folded along the side fold lines to form an inner frame. The inner frame is bonded to the inner pack IP. Subsequently, the inner pack IP provided with the inner frame is transferred while the fourth wheel 34 rotates.

Further connected to the fourth wheel 34 is a main blank feeder 36. The main blank feeder 36 feeds a main blank (outer wrapper) to the inner pack IP on the fourth wheel 34. As illustrated in FIG. 1, the main blank feeder 36 has a hopper 37 storing main blanks. The main blanks are transferred one by one from the hopper 37 through a feeding path $P_{MB}$ to the fourth wheel 34, and are fed to the respective inner packs IP at a feeding position of the fourth wheel 34. More specifically, each of the main blanks is placed on the corresponding inner pack IP so as to sandwich the inner pack IP in cooperation with the inner frame.

A fifth wheel 38 is disposed in a vertical position right above the feeding position of the fourth wheel 34. The fifth wheel 38 has a plurality of folding pockets (not shown). While the fifth wheel 38 rotates, each of the folding pockets receives the corresponding inner pack IP having the inner frame and the main blank from the fourth wheel 34. At this point, a pair of inner side flaps of the main blank is folded. The received inner pack IP is then transferred in a circumferential direction of the fifth wheel 38. In this transferring process, the rest of the folding process with respect to the main blank is carried out in order, to thereby form a cigarette package SP.

Thereafter, the cigarette package SP is transferred from the fifth wheel 38 through a sixth wheel 39, a seventh wheel 40 and an eighth wheel 41 to a delivery line 42. The delivery line 42 feeds the cigarette package SP to a film-wrapping machine. The film-wrapping machine wraps the cigarette package in a film sheet.

The scratching devices 19 and 20 will be described below. As the scratching devices 19 and 20 have identical structures, the following description will be only about the scratching device 19 to avoid repeating a similar description.

Figure 2:
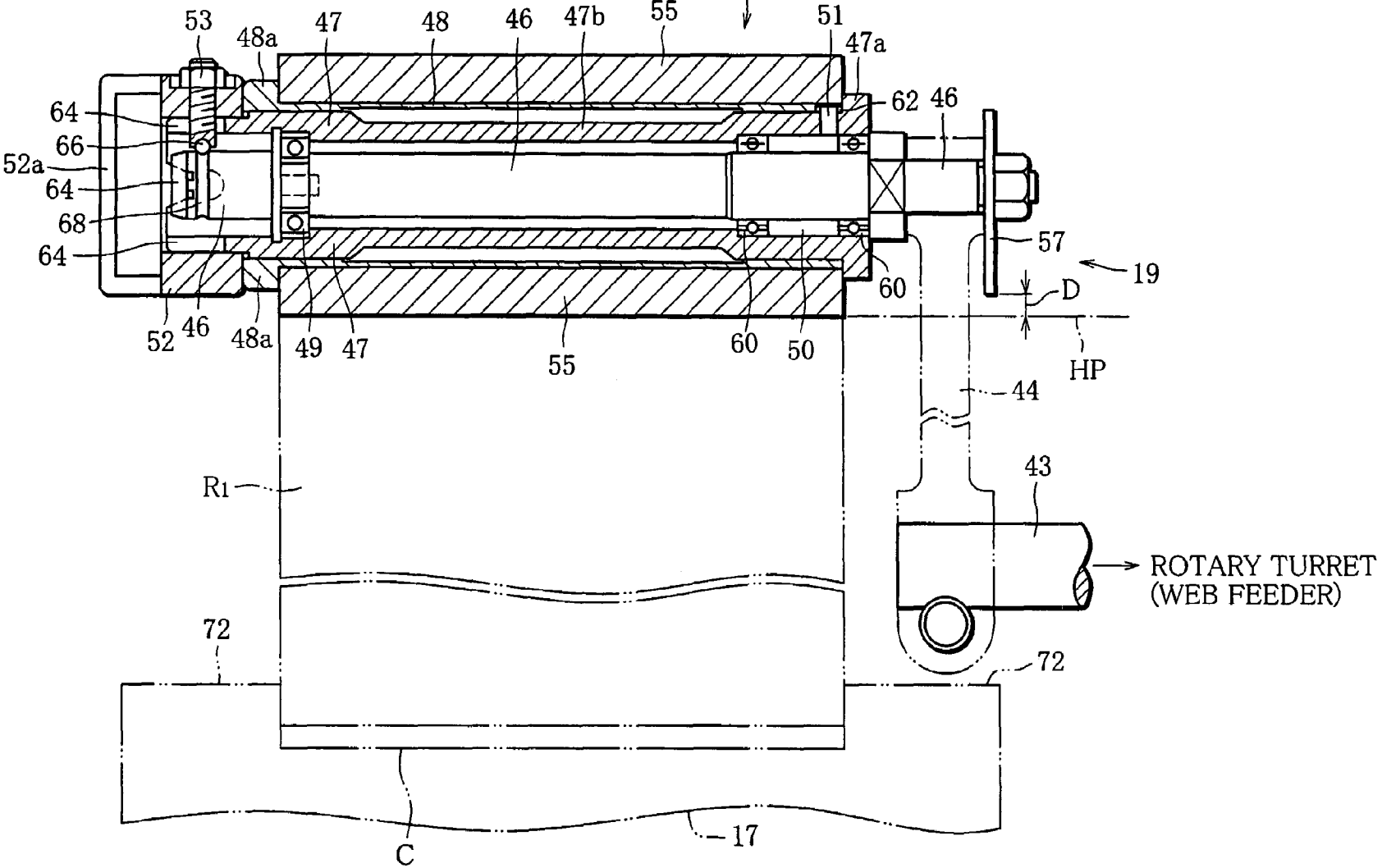
FIG. 2 is a vertical sectional view showing one of the scratching devices of FIG. 1.

As illustrated in FIG. 2, the scratching device 19 has a support shaft 43. The support shaft 43 horizontally extends from the rotary turret 16 of the inner wrapper feeder 15 and includes a distal end. Rotatably mounted on the distal end of the support shaft 43 is an arm 44 or a proximal end thereof. The arm 44 extends toward the web roll $R_1$.

A return coil spring (not shown) is disposed between the proximal end of the arm 44 and the support shaft 43, and a scraper roller 45 is fixed to a distal end of the arm 44. The return coil spring urges the scraper roller 45 toward the web roll $R_1$ using the arm 44. This presses the scraper roller 45 against an outer circumferential surface of the web roll $R_1$.

More specifically, the scraper roller 45 has a roller shaft 46. The roller shaft 46 extends parallel with an axis of the web roll $R_1$. A distal end of the roller shaft 46 is unrotatably supported by the distal p end of the arm 44.

A sleeve 47 is concentrically disposed outside the roller shaft 46. The sleeve 47 extends in an axial direction of the roller shaft 46 and has a flange 47*a* at one end on the arm 44 side. There is formed a circumferential groove 47*b* in the middle of an outer circumferential surface of the sleeve 47 as viewed in the axial direction of the sleeve 47.

A pair of bearings 60 is disposed in one end portion of the sleeve 47. The bearings 60 are disposed away from each other in the axial direction of the sleeve 47 and support the one end portion of the sleeve 47 so as to be rotatable with respect to the roller shaft 46. A bearing 49 is disposed in the other end portion of the sleeve 47. The bearing 49 supports the other end portion of the sleeve 47 so as to be rotatable with respect to the roller shaft 46.

Disposed between the one end portion of the sleeve 47 and the roller shaft 46 is a one-way clutch 50. The one-way clutch 50 is sandwiched between the bearings 60. The one-way clutch 50 allows the sleeve 47 to rotate only in one direction in relation to a circumferential direction of the roller shaft 46.

Disposed in the outer circumferential surface of the sleeve 47 is a roller shell 48 formed into a hollow cylinder. The roller shell 48 extends from the one end portion of the sleeve 47 to the other end portion thereof to cover the circumferential groove 47*b* of the sleeve 47. The roller shell 48 has one end in contact with the flange 47*a* of the sleeve 47 and a flange 48*a* formed in the other end thereof.

An axial groove 62 is formed in an inner circumferential surface of the one end in the roller shell 48. The axial groove 62 opens in one end face of the roller shell 48. A pin 51 is protruding from an outer circumferential surface of a distal end portion in the sleeve 47. The pin 51 is fitted into the axial groove 62. The axial groove 62 and the pin 51 are engaged with each other to cause the roller shell 48 and the sleeve 47 to rotate integrally. However, the axial groove 62 and the pin 51 allow the sleeve 47 to move in the axial direction of the roller shell 48 toward the distal end side of the roller shaft 46. Accordingly, the roller shell 48 can be pulled out from the sleeve 47 toward the distal end side of the roller shaft 46.

As is apparent from FIG. 2, the distal end portion of the sleeve 47 is protruding from the other end or the flange 48*a* of the roller shell 48. Fixed to the distal end of the sleeve 47 is a ring-shaped stopper 52. The stopper 52 is in contact with the flange 48*a* of the roller shell 48, to thereby prevent the roller shell 48 from dropping out of the sleeve 47.

More specifically, the stopper 52 has a plurality of stopper bolts 53. The stopper bolts 53 are arranged away from each other in a circumferential direction of the stopper 52. Each of the stopper bolts 53 is screwed into the stopper 52, and has an inner end inserted into the sleeve 47. In other words, a plurality of axial grooves 64 corresponding to the stopper bolts 53 are formed in the distal end portion of the sleeve 47. The axial grooves 64 open in the distal end face of the sleeve 47. Therefore, the stopper bolts 53 are allowed to enter the sleeve 47 through the axial grooves 64. Balls 66 are hold in the distal ends of the respective stopper bolts 53. The balls 66 are fitted in a circumferential groove 68 of the sleeve 47. The circumferential groove 68 is formed in the outer circumferential surface of the distal end portion of the sleeve 47.

Figure 3:
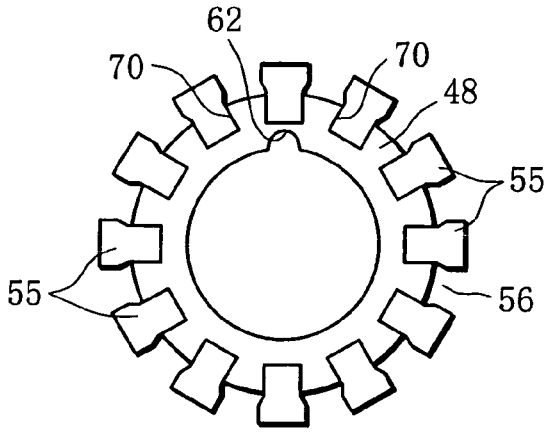
FIG. 3 is an end elevation view showing a scraper roller of FIG. 2.

As illustrated in FIG. 3, a plurality of mounting grooves 70 are formed in an outer circumferential surface of the roller shell 48. The mounting grooves 70 extend in the axial direction of the roller shell 48, and are arranged at regular intervals in a circumferential direction of the roller shell 48. Scrapers 55 are fitted into the respective mounting grooves 70. The scrapers 55 are made, for example, of felt material, and each have a substantially rectangular cross section. The scrapers 55 are protruding from the outer circumferential surface of the roller shell 48 and extend between the flange 47*a* of the sleeve 47 and the flange 48*a* of the roller shell 48 along the mounting grooves 70. Therefore, the scraper roller 45 has a plurality of concavities 56 arranged in the circumferential direction of the roller shell 48. Each of the concavities 56 is defined between two adjacent scrapers 55.

As illustrated in FIG. 2, a detection disc 57 is eccentrically mounted on the proximal end of the roller shaft 46. The detection disc 57 is located adjacently to the distal end of the arm 44. When the scraper roller 45, or the scraper 55, is in contact with the outer circumferential surface of the web roll $R_1$, there is secured a given distance D between a horizontal plane HP including the end face of the scrapers 55 and the detection disc 55. The bobbin 17 of the web roll $R_1$ has flanges 72 disposed in both ends thereof. The flange 72 on the rotary turret 16 side and the detection disc 57 are located in the same vertical plane. In FIG. 2, reference character C denotes the core of the web roll $R_1$.

Operation of the above-mentioned scratching device 19 will be described below.

Figure 4:
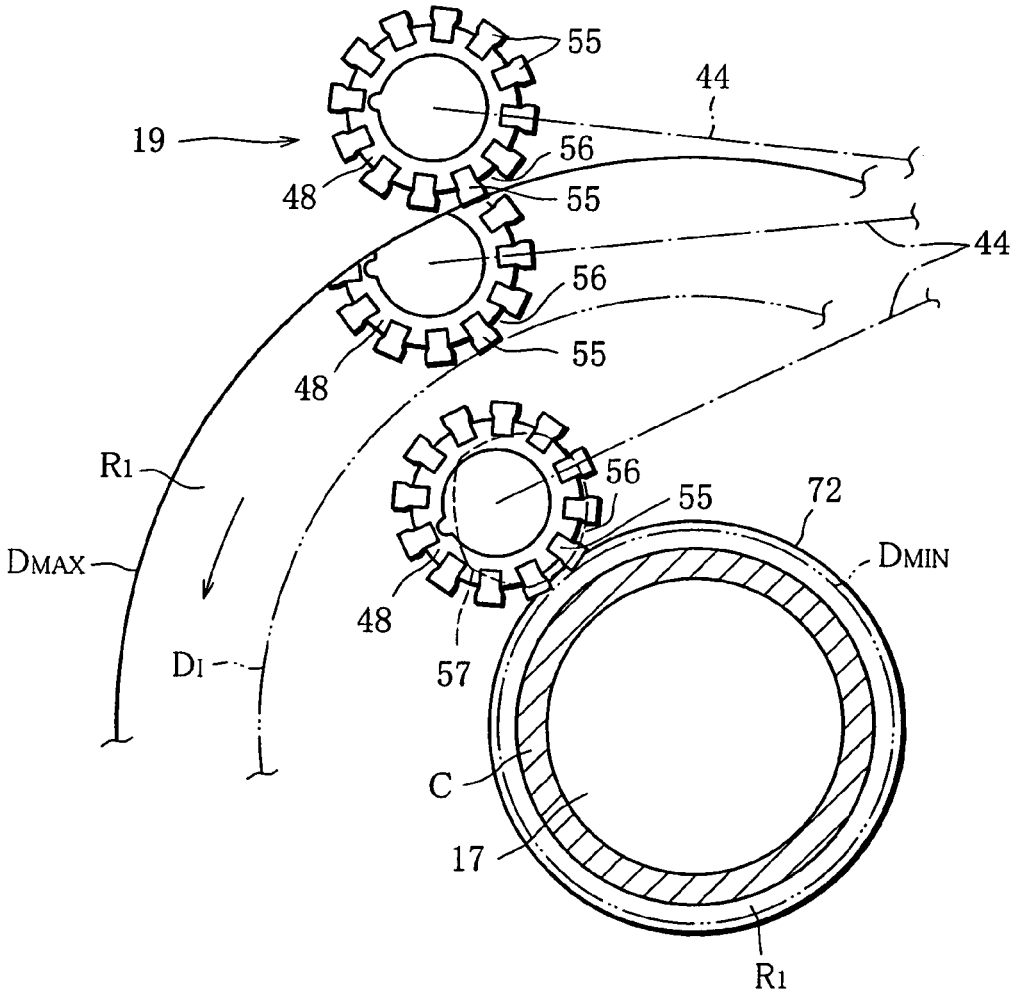
FIG. 4 is a view showing an operation process of one of the scratching device of FIG. 1.

As stated, when the web W is delivered from the web roll $R_1$, at least one of the scrapers 55 of the scraper roller 45 is pressed against the outer circumferential surface of the web roll $R_1$ as illustrated in FIG. 4.

When the web roll $R_1$ is rotated in a direction of an arrow in FIG. 4, that is, counterclockwise while the web W is delivered, the scraper roller 45 receives a clockwise rotating force from the web roll $R_1$. However, the one-way clutch 50 of the scraper roller 45 inhibits the rotation of the scraper roller 45. As a result, the scraper 55 is kept in a state pressed against the outer circumferential surface of the web roll $R_1$, namely an outside face of the web W, and the web W is delivered from the web roll $R_1$ while the outside face thereof slides against the scraper 55.

Figure 5:
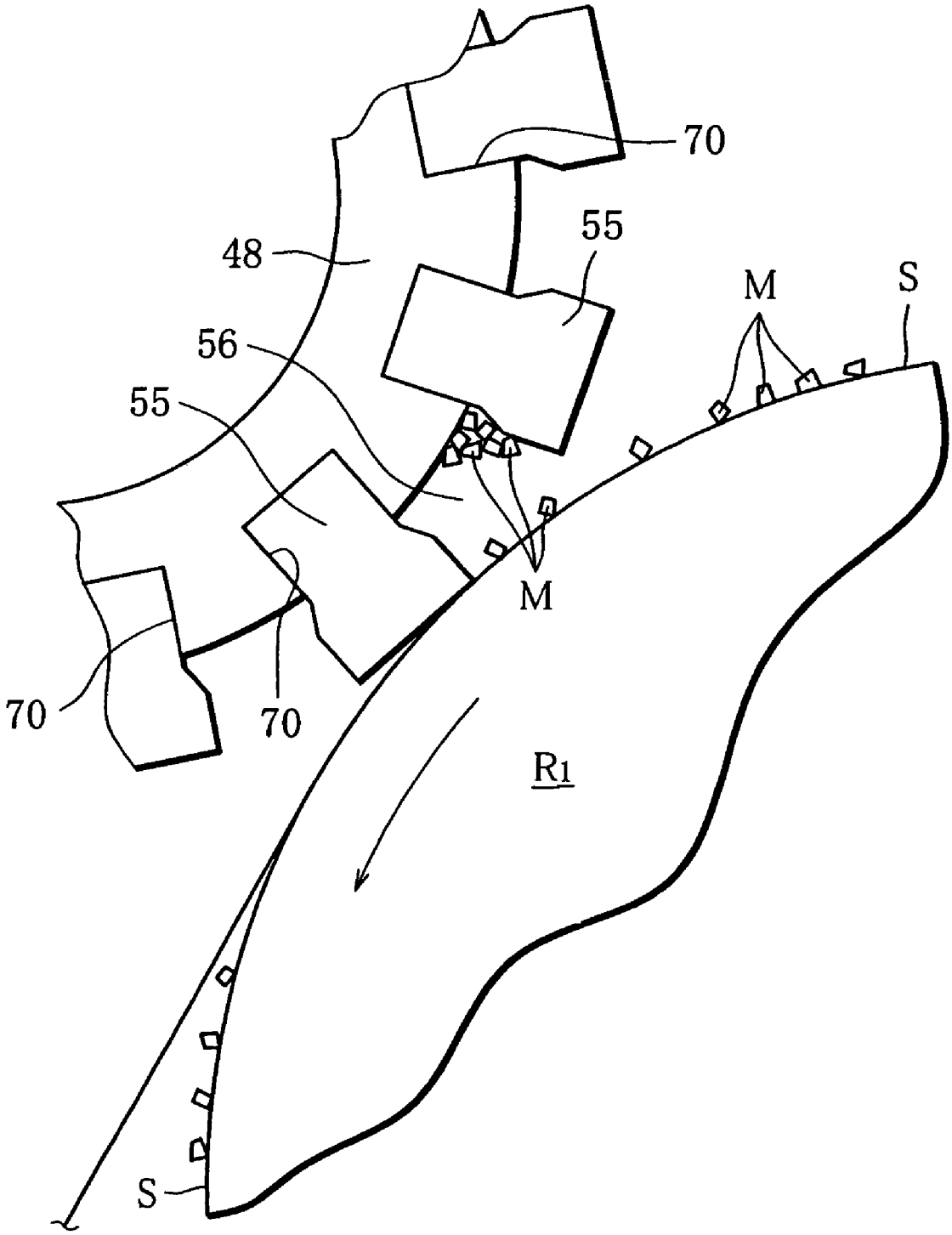
FIG. 5 is a view showing a part of FIG. 4 in an enlarged scale.

As mentioned, the web roll $R_1$ is formed by winding the web W around the core C, and the paper layer of the web W is infiltrated with menthol. Therefore, when the web W is in the form of the web roll R, the menthol is transferred from the paper layer to the outside face of the adjoining web W, that is, the aluminum foil, so that menthol M adheres onto the outside face S of the web W as illustrated in FIG. 5.

When the web W is delivered from the web roll $R_1$, however, the outside face S of the web W is brought into sliding contact with the scraper 55, so that the menthol M that has adhered onto the front face S is scraped by the scraper 55 and removed or cleaned from the outside face S. Since the scraper 55 is made of felt material, the scraper 55 can scrape the menthol M off the outside face S reliably and effectively without damaging the outside face S. The scraped menthol M is trapped and accumulated in the concavity 56 of the scraper roller 45. Consequently, the menthol M does not spatter around the scraper roller 45, and then does not stain the periphery of the scraper roller 45.

When the web W is delivered from the web roll $R_1$, the menthol M on the outside face of the web W is immediately removed or cleaned by the scraper 55 as described above. Therefore, in the feeding path $P_W$, the adhesion of the menthol to a large number of the guides brought into contact with the outside face S of the web W, that is, smudges on the feeding path $P_W$ caused by adhesion of the menthol, are reduced. This prevents the web W from slipping, meandering, jamming and the like in the feeding path $P_W$, thereby cutting the web W by the cutting unit 29 with accuracy. As a result, it is possible not only to obtain the inner wrapper IW of regulation size but also to accurately position the inner wrapper IW in the feeding position between the first wheel 12 and the second wheel 14, to thereby wrap the cigarette bundle in the inner wrapper IW satisfactorily.

As the web W is continuously delivered from the web roll $R_1$, a diameter of the web roll $R_1$ is reduced. In other words, as illustrated in FIG. 4, an external diameter of the web roll $R_1$ is reduced from a maximum external diameter $D_{MAX}$ (solid line) to an intermediate external diameter $D_1$ (double dashed line) to a minimum external diameter $D_{MIN}$ (single dashed line) indicative of a use limit of the web roll $R_1$.

When the external diameter of the web roll $R_1$ reaches the minimum external diameter $D_{MIN}$, that is to say, when the outside face S of the web roll $R_1$ reaches further inside than the outer circumferential surface of the flange 72 of the bobbin 17 in a radial direction of the bobbin 17 as is obvious from FIG. 4, the eccentric disc 57 is brought into contact to the outer circumferential surface of the flange 72. At this point, a detection sensor (not shown) for detecting a remaining amount of the web W in the web roll $R_1$ is turned ON. As a detection sensor, a sensor for detecting electric conduction and mechanical contact between the eccentric disc 57 and the flange 72 may be utilized.

Once the detection sensor is turned ON, the operation of the automatic splicing unit 21 is started. The automatic splicing unit 21 switches the delivery of the web W from the web roll $R_1$ to the web roll $R_2$.

When the web W is delivered from the web roll $R_2$, a scraper of the scratching device 20 remove or clean the menthol that has adhered onto the outside face S of the web W in the same manner as the scraper 55 of the scratching device 19.

Subsequently, the rotary turret 16 is rotated counter clockwise to make approximately a half rotation, in view of FIG. 1. The web roll $R_1$ of the bobbin 17 is moved to the standby position, and the web roll $R_2$ of the bobbin 18 to the active position.

In the above-described state, the web roll $R_1$ of the bobbin 17 is replaced with a new web roll, which will serve as a standby roll. At this point, the scraper roller 45 of the scratching device 19 is manually rotated at a given angle in a direction allowed by the one-way clutch 50. Due to this rotation, a new scraper 55 of the scraper 45 is pressed against the outer circumferential surface of the standby roll. Accordingly, each time the web roll R is replaced, a new scraper 55 is pressed against the outside face of the web W of the standby roll.

When all the scrapers 55 of the scraper 45 are used, the stopper 52 is detached from the sleeve 47, and the roller shell 48 is pulled out from the sleeve 47 with the scrapers 55. Thereafter, the roller shell 48 having new scrapers is fixed to the sleeve 47.

The detached roller shell 48 can be reused after the menthol M in the concavities 56 is removed.

In general, the remaining amount of the web roll, namely the minimum external diameter $D_{MIN}$ of the web roll, is detected by the angle of the arm 44 in the scratching device. However, the scraper 55 of the scraper roller 45 is liable to deform, so that it is not proper that the remaining amount of the web roll is detected on the basis of the angle of the arm 44.

The invention claimed is:

1. A feeding apparatus for feeding an inner wrapper for wrapping a cigarette bundle, comprising:

a web roll rotatably supported and wound with a web that is material for the inner wrapper, the web including metal foil, and a paper layer that is laminated on the metal foil and contains an aromatic substance;

a feeding path for guiding the web delivered from said web roll to a feeding position;

a cutting unit arranged in said feeding path, for cutting the web to form the inner wrapper;

a cleaner arranged in said feeding path including said web roll, for cleaning a surface of the metal foil of the web; and a holder fastened to a distal end of the arm and having the scraper, wherein said cleaner includes an arm having a proximal end rotatably supported near said web roll, the arm being urged toward the outer circumferential surface of said web roll, wherein the holder is rotatable with respect to the arm and has a plurality of scrapers, and wherein the holder is a scraper roller including:

a roller shaft supported by the arm, a sleeve rotatably supported by the roller shaft, a one-way clutch disposed between the sleeve and the roller shaft, for allowing the sleeve to only rotate in the same direction as a rotating direction of said web roll, and a roller shell detachably fixed onto the sleeve, and the scrapers is arranged in an outer circumferential surface of the roller shell at intervals in a circumferential direction of the roller shell.

2. The feeding apparatus according to claim 1, wherein: the aromatic substance is menthol.

3. The feeding apparatus according to claim 2, wherein: said cleaner includes a scraper brought into sliding contact with the surface of the metal foil at an outer circumferential surface of said web roll.

4. The feeding apparatus according to claim 1, wherein: the scrapers are made of felt material.

5. The feeding apparatus according to claim 4, further including a detector for detecting whether or not a diameter of said web roll reaches a minimum diameter that determines a use limit of said web roll.

6. The feeding apparatus according to claim 5, wherein: the detector includes:

a bobbin for supporting said web roll and having a flange; and a contact member fixed to the scraper roller, the contact member being brought into contact with the flange of the bobbin when the diameter of said web roll reaches the minimum diameter.

* * * * *